US006617808B2

(12) United States Patent
Ito et al.

(10) Patent No.: US 6,617,808 B2
(45) Date of Patent: Sep. 9, 2003

(54) DISCHARGE-LAMP LIGHTING CIRCUIT

(75) Inventors: Masayasu Ito, Shizuoka (JP); Akihiro Mochizuki, Shizuoka (JP); Hitoshi Takeda, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 10/071,202

(22) Filed: Feb. 11, 2002

(65) Prior Publication Data

US 2002/0109467 A1 Aug. 15, 2002

(30) Foreign Application Priority Data

Feb. 13, 2001 (JP) ..... P2001-034979
Aug. 10, 2001 (JP) ..... P2001-243665

(51) Int. Cl.[7] ..... G05F 1/00

(52) U.S. Cl. ..... 315/291; 315/309; 315/307; 315/246

(58) Field of Search ..... 315/291, 307, 315/309, 194, 209 R, 224, 225, 246, 310, 311, DIG. 7, 247

(56) References Cited

U.S. PATENT DOCUMENTS 5,663,613 A * 9/1997 Yamashita et al. ..... 315/308
5,907,224 A * 5/1999 Yamashita et al. ..... 315/308

* cited by examiner

*Primary Examiner*—Don Wong
*Assistant Examiner*—Tuyet T. Vo
(74) *Attorney, Agent, or Firm*—Sughrue Mion, PLLC

(57) ABSTRACT

In a discharge-lamp lighting circuit 1, a DC-DC converter circuit 3 for boosting or lowering DC input voltage Vin from a DC power supply 2, a DC-AC converter circuit 4 for converting the output voltage of the DC-DC converter circuit to AC voltage, and a control circuit 9 for controlling the supply of electric power to a discharge lamp 6 are provided. Further, the supply of power to the discharge lamp 6 is decreased in response to the lowering of the DC input voltage when the lowering of the DC input voltage Vin is detected. The supply of power to the discharge lamp 6 is lowered as the ambient temperature rises even though the lowering of the DC input voltage Vin remains unchanged.

12 Claims, 14 Drawing Sheets

DISCHARGE-LAMP LIGHTING CIRCUIT

BACKGROUND OF THE INVENTION

1. Field of the Invention

The present invention relates to the art of taking measures against heat build-up in a discharge-lamp lighting circuit.

2. Description of the Related Art

There is a known discharge-lamp lighting circuit configuration comprising a DC power supply circuit, a DC-AC converter circuit (DC-DC converter) and a starting circuit (a so-called starter circuit). In such a circuit configuration using a DC-DC converter circuit in a DC power supply circuit, for example, a full-bridge type circuit (a circuit for performing on-off control by using two sets of four semiconductor switching elements) with a driver circuit is employed as the DC-AC converter circuit, wherein the output voltage of the DC-DC converter circuit is converted to rectangular-wave voltage in the full-bridge type circuit before being supplied to a discharge lamp.

In consideration of applying the aforementioned art to automotive discharge lamps, it has been known to perform control (so-called derating control) over a lowering of output power to be supplied to discharge lamps in proportion to a voltage drop when input voltage from a power supply lowers in case where DC power supplies (batteries) are employed in lighting circuits. In this case, the purpose is for only preventing the exhaustion of the battery but also protecting the lighting circuit. In the case of the latter, battery current (input current) tends to increase in case where control works to maintain the supply of prescribed power though the battery voltage is lowering. Consequently, there is the fear of causing loss to increase and electric conversion efficiency (ratio of the output power to the input power) to worsen. Incidentally, the worsening of the conversion efficiency results in increasing loss as the battery current increases further and when this vicious cycle is accelerated, the generation of heat in the circuit and the heat destruction thereof may occurs if the worst to the worst.

Therefore, as a countermeasure, it is necessary for performing a control to lower the supply of the output power to the discharge lamp in proportion to the lowering of the application of the input voltage to the lighting circuit and the following forms are known, for example.

(1) A form of detecting and monitoring the battery current using current detecting elements (e.g., shunt resistors) so as to limit the current to the extent that its detected value is a predetermined current value or less.

(2) A form of limiting currents flowing through switching elements constituting a DC-DC converter (e.g., a pulse by pulse current limiting method).

(3) A form of lowering the supply of power to the discharge lamp when the lowering of the battery voltage is detected while the batter voltage is being monitored.

In the forms (1) and (2), such heat destruction is prevented by observing the current value directly concerned with the generation of heat in the circuit to limit the current so that no excessive current is allowed to flow into the current, which results in lowering the supply of power to the discharge lamp.

With regard to the form (3), the output power may be controlled in accordance with the characteristics conceptually shown in FIG. 7, for example, wherein the battery voltage (referred to 'Vin') is taken on the horizontal axis, whereas the supply of power (referred to 'PW') to the discharge lamp is taken on the vertical axis, whereby control characteristics are shown by a graphic line g.

The flat portion of the graphic line g indicates the rated power of the discharge lamp and in case where the input voltage Vin from the battery is within tolerance, rated power is supplied to the discharge lamp while the discharge lamp is steadily lighted. However, the supply of power PW is so controlled that the power is lowered as the value of Vin decreases (see the tilted portion of the graphic line g).

Nevertheless, unsatisfactory measures have been taken to counter the generation of heat in circuits as well as the heat destruction of circuits according to the conventional methods and the following inconvenience may be caused.

On the assumption that lighting circuits are used in cold districts (the ambient temperature is low), though there is still a margin for a change in the temperature until circuit failure occurs, the derating function for decreasing the supply of power to a discharge lamp inevitably works as input voltage lowers and it is feared that the brightness of the discharge lamp grows weaker than what is prescribed. Conversely, a margin for a change in the temperature falls because the ambient temperature rises (e.g., due to the generation of heat from the engine of a vehicle) and when danger of circuit failure increases, it is still feared that a current limiting function for sufficiently preventing heat build-up and a power lowering function are not demonstrated.

SUMMARY OF THE INVENTION

A problem to be solved by the invention is to take satisfactory measures to counter the generation of heat in a discharge-lamp lighting circuit in consideration of the ambient temperature.

In order to solve the foregoing problems, a discharge-lamp lighting circuit according to the invention comprises a DC-DC converter circuit for boosting or lowering DC input voltage from a DC power supply, a DC-AC converter circuit for converting the output voltage of the DC-DC converter circuit to AC voltage, and a control circuit for controlling the supply of electric power to a discharge lamp, whereby the supply of power to the discharge lamp is controlled by the control circuit in response to the lowering of the DC input voltage when the lowering of the DC input voltage is detected, wherein power control is performed so that the supply of power to the discharge lamp is decreased by the control circuit as the ambient temperature rises even though the lowering of the DC input voltage remains unchanged.

According to the invention, the supply of power to the discharge lamp decreases as the ambient temperature rises when the DC input voltage lowers even though the lowering of the DC input voltage remains unchanged, whereby satisfactory measures can be taken to counter heat build-up by suppressing the generation of heat in the circuit due to the ambient temperature rise. Therefore, it is possible to avoid the inconvenience caused by decreasing the supply of power to the discharge lamp more than necessary when the ambient temperature is low.

DESCRIPTION OF THE PREFERRED EMBODIMENTS

Figure 1:
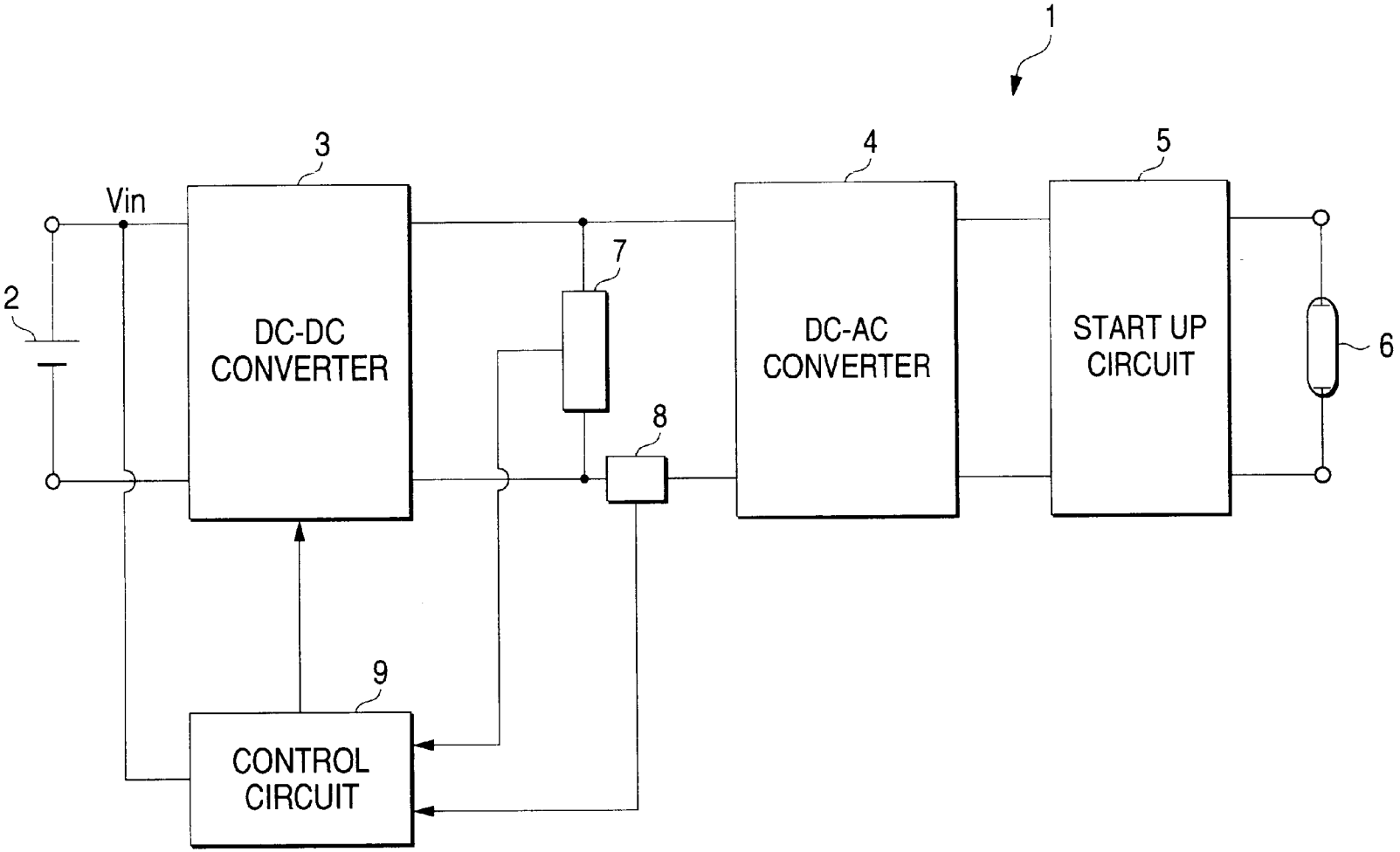
FIG. 1 shows a circuit block diagram showing the basic arrangement of a discharge-lamp lighting circuit according to the invention.

FIG. 1 shows the basic arrangement of the invention, wherein a discharge-lamp lighting circuit 1 comprises a DC power supply 2, a DC-DC converter circuit 3, a DC-AC converter circuit 4 and a starting circuit 5.

On receiving DC input voltage (hereinafter called the 'DC input voltage Vin') from the DC power supply 2, the DC-DC converter circuit 3 boosts or lowers the DC input voltage so as to output a desired DC voltage, the output voltage being variably controlled according to a control signal from a control circuit as will be described later. A DC-DC converter (of a chopper type or a fly-back type) having a switching regulator, for example, is employed as the DC-DC converter circuit 3.

The DC-AC converter circuit 4 is provided so as to supply the output voltage of the DC-DC converter circuit 3 to the discharge lamp 6 after converting the output voltage thereof to AC voltage. As the DC-AC converter circuit 4, use can be made of a bridge type circuit (a bridge circuit or a half-bridge circuit) using a plurality of semiconductor switching elements with its driving circuit; however, any other circuit arrangement is acceptable as far as the invention is concerned.

The starting circuit 5 is provided so as to start a discharge lamp 6 by causing a starting high-voltage signal (starting pulse) to be generated in the discharge lamp 6. The starting signal is superposed on the AC voltage output from the DC-AC converter circuit 4 before being applied to the discharge lamp 6.

As a detection circuit for detecting the voltage or current applied to the discharge lamp 6, the following forms may be enumerated.

In order to directly detect the pipe voltage and pipe current of the discharge lamp, current detecting elements (such as shunt resistors and detecting transformers) are connected to the discharge lamp, for example, so as to detect the value of current flowing through the element; and voltage equivalent to the pipe voltage and the pipe current of the discharge lamp is detected.

As shown in FIG. 1, a voltage detecting means 7 (e.g., a circuit for detecting output voltage by using a voltage dividing resistor) and a current detecting means 8 (e.g., a detection resistor element) are provided successively right behind the DC-DC converter circuit 3 whereby to use equivalent signals (or substitute signals) of the voltage and current applied to the discharge lamp 6, the equivalent signals being sent out to a control circuit 9.

The control circuit 9 is used to control the supply of power to the discharge lamp 6 and when a fall in the DC input voltage Vin is detected, functions as what decreases the supply of power to the discharge lamp in proportion to the degree of the fall of the DC input voltage Vin. In controlling the supply of power (output power) to the discharge lamp 6, the control circuit 9 controls the power so that the supply of power to the discharge lamp decreases as the ambient temperature rises even though the fall of the DC input voltage Vin remains unvaried by adopting the DC input voltage Vin and the ambient temperature as control parameters. In other words, the control is performed such that the greater the rise in the temperature, the greater the lowering of the supply of power is made, in consideration of the ambient temperature of the discharge-lamp lighting circuit. The reason for this is that in the conventional circuit, only the DC input voltage Vin as the derating control parameter has been taken into consideration as stated above.

However, designing a novel circuit for monitoring and compensating for the ambient temperature again quite causes an increase in not only the circuit scale but also the cost.

It is therefore preferred to deal with the temperature compensation concerning the derating control by altering the configuration of the existing control circuit that performs power control over the discharge lamp.

Figure 2:
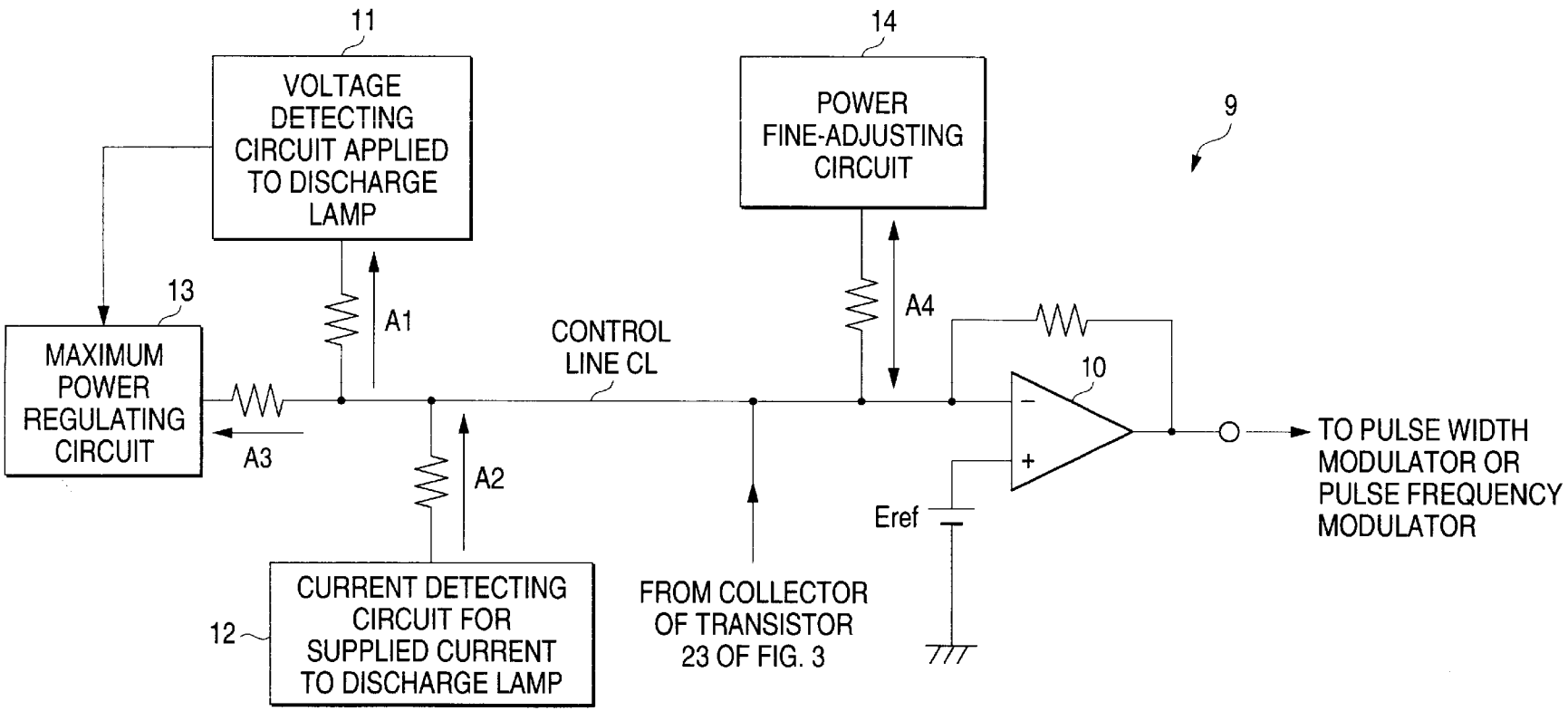
FIG. 2 shows a diagram illustrating power control in a control circuit.

FIG. 2 is a diagram showing the principal part of a control circuit in assuming power control. As any control system is adoptable as far as the invention is concerned, the power control may be intended for control of PWM (Pulse Width Modulation) or PFM (Pulse Frequency Modulation), for example.

A predetermined reference voltage Eref (shown by a symbol of constant-voltage power supply in FIG. 2) is supplied to the positive-side input terminal of an error amplifier 10, whereas the circuits shown below (by corresponding reference numerals in parentheses) are connected to the negative-side input terminals thereof.

Voltage detecting circuit (11) for detecting the voltage applied to the discharge lamp.

Current detecting circuit (12) for detecting the current flowing through the discharge lamp.

Maximum making-power regulating circuit (13).

Power fine-adjusting circuit (14).

Of these circuits, the voltage detecting circuit 11 is provided for detecting the voltage carried by the discharge lamp 6 and fed with a detection signal from the voltage detecting means 7, for example. The current detecting circuit 12 is used to detect the current carried by the discharge lamp 6 and fed with the detection signal from the current detecting means 8, for example.

When the control range of turning on the discharge lamp is divided into a transient area applicable until the discharge lamp is stabilized and a steady area in which the discharge lamp is lighted steadily with stability, the maximum making-power regulating circuit 13 is a circuit for defining the maximum power supply value (or an upper limit allowable value) in the transient area when the discharge lamp is turned on in its cold condition. Further, the power fine-adjusting circuit 14 is a circuit necessary for finely adjusting a power supply value in constant-power control in the steady area.

With this arrangement, the supply of power to the discharge lamp increases as the output voltage of the error amplifier 10 increases (the error amplifier 10 adjusts the output voltage of the DC-AC converter circuit so that the negative-side input voltage of the error amplifier 10 is equal to the reference voltage Eref). The output voltage of the error amplifier 10 is converted into a control signal toward the switching element (semiconductor element) in the DC-DC converter via the PWM (or PFM) control portion (not shown) (e.g., a circuit portion formed with an all purpose IC for control of PWM and used for generating a pulse signal whose duty cycle varies with the result of the level comparison between the input voltage and the saw tooth wave).

Further, each of the arrows A1 to A4 shown near each signal line connected to each circuit portion with respect to the control line CL connected to the negative-side input terminal of the error amplifier 10 indicates contribution to the current supplied to the error amplifier 10 by each circuit portion and the direction of each arrow corresponds to the direction of the control current from each portion as a reference. For example, as the directions of the respective control currents from the voltage detecting circuit 11 (see arrow A1) and the maximum making-power regulating circuit 13 (see arrow A3) are defined as the directions (of sink currents) in which the control currents out of them recede from the error amplifier 10, the supply of power to the discharge lamp increases as the value of each of the currents flowing in that direction increases. Moreover, as the direction of the control current out of the current detecting circuit 12 (see arrow A2) is defined as the direction (of a source current) in which its control current flows toward the error amplifier 10, the supply of power to the discharge lamp decreases as the value of the current flowing in that direction increases. Regarding to the control current from the power fine-adjusting circuit 14, the power adjustment can be made in both directions as shown by a double headed arrow A4 and when the adjustment is made in a direction receding from the error amplifier 10, the supply of power increases in the steady area (when the adjustment is made toward the error amplifier 10, the supply of power decreases in the steady area).

The contribution of the control currents by means of the voltage detecting circuit 11, the current detecting circuit 12 and the maximum making-power regulating circuit 13 allows the supply of power to the discharge lamp to be regulated in accordance with the lighted condition of the discharge lamp. When the voltage applied to the discharge lamp is low, great power is fed into the discharge lamp (however, as is seen from the arrow directed from the voltage detecting circuit 11 to the maximum making-power regulating circuit 13, the maximum power value is determined by reference to the detected voltage). Moreover, the supply of power to the discharge lamp tends to be decreased).

As is generally known, the constant-power control in the steady area of the discharge lamp is performed so that a relation of V·I=W where V=pipe voltage, I=pipe current and W=rated power value or otherwise a relation of V+I=W obtainable from linear approximation is established (though the voltage detecting circuit and the current detecting circuit may be made complicated in configuration so as to conduct approximation to a constant-power curve using many polygonal lines to improve approximation further, it will be needed to take demerits into consideration accompanied with an increase in the number of parts).

As the control current from the maximum making-power regulating circuit 12 can be considered absent in the steady area, control is performed so that the control currents by means of the voltage detecting circuit 11, the current detecting circuit 12 and the power fine-adjusting circuit 14 come up to zero ampere in total (i.e., though the equilibrium of the input voltage and the reference voltage in the error amplifier 10 is maintained in this state, when the input voltage lowers in case where this state collapses, for example, the output voltage of the amplifier increases, thus resulting in increasing the supply of power, whereas when the input voltage rises, the output voltage of the amplifier lowers, thus resulting in decreasing the supply of power).

Although the output terminal of each circuit is connected to the control line CL via the corresponding resistor as shown in FIG. 2, these resistors may be dispensed with by employing constant current. At any rate, an arrangement is made to increase the supply of power to the error amplifier by performing the current control in the direction of sinking the current from the control line CL while the supply of power to the discharge lamp is varied with the output voltage of the error amplifier and to decrease the supply of power to the error amplifier by performing the current control in the source direction (or otherwise it is needless to say possible to employing an arrangement to be made contrary to the invention).

FIGS. 3 to 6 are intended to explain an example of a circuit configuration concerning the derating control in such a form that the supply of power to the discharge lamp is decreased by sourcing the current with respect to the control line CL.

Voltage dividing resistors as detection elements for detecting the DC input voltage Vin are provided in these circuits and an ambient-temperature monitoring or compensating element is connected to each detection element. Although the monitoring or compensating element such as a thermistor or a linear resistor element in addition to a transistor or a diode may be used as the monitoring or compensating element, a transistor is employed as an equivalent diode according to this embodiment of the invention.

Figure 3:
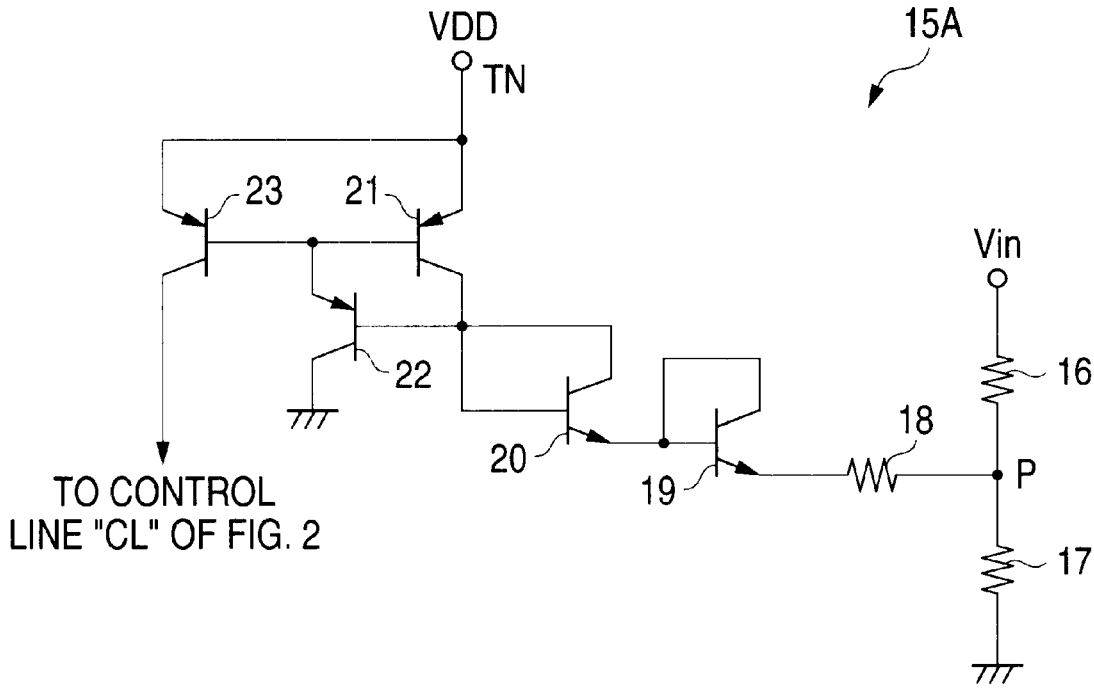
FIG. 3 shows a circuit diagram showing a configuration of the principal part.
Figure 6:
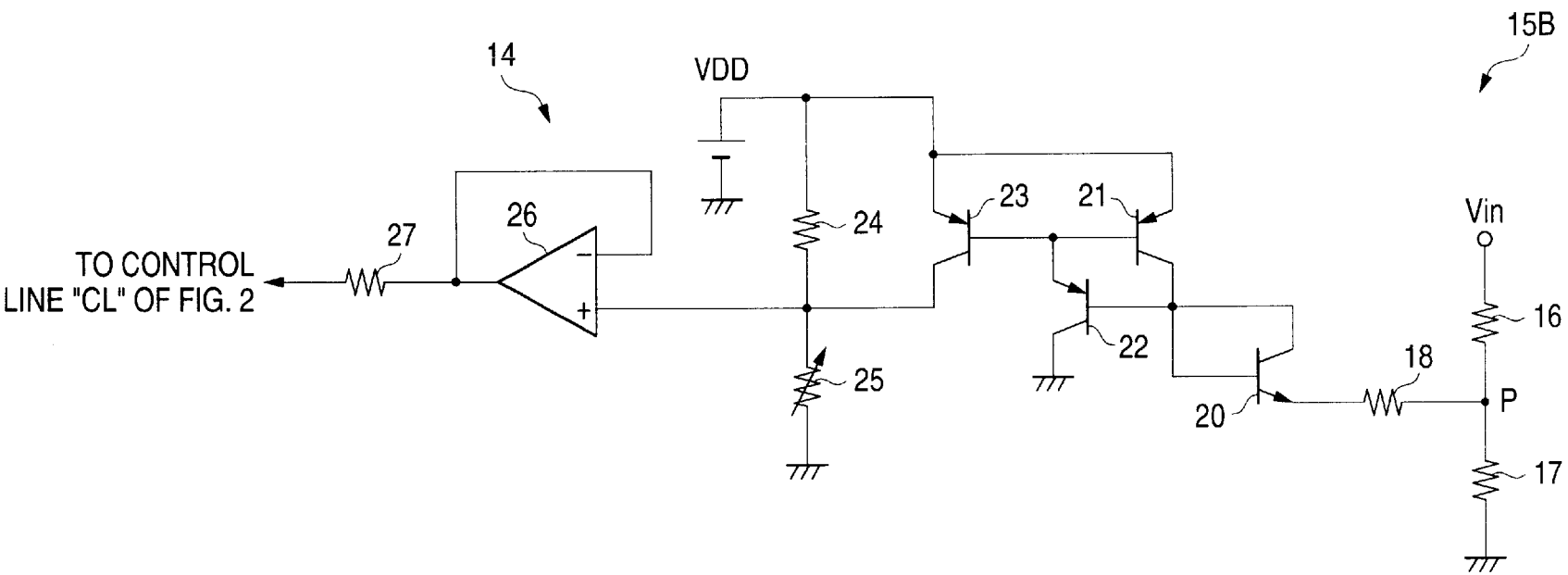
FIG. 6 shows a circuit diagram showing a configuration different from what is shown in FIG. 3.

Moreover, the supply of power to the discharge lamp is controlled (lowered) by influencing the control line CL of the control circuit 9 according to the detection signal obtainable from the detection element via the monitoring or compensating element, that is, by directly sourcing the current with respect to the control line in a configurative example 15A of FIG. 3 and by indirectly sourcing the current with respect to the control line CL via the power fine-adjusting circuit 14 in a configurative example 15B of FIG. 6.

As shown in FIG. 3, voltage dividing resistors 16 and 17 are provided with respect to the voltage Vin fed from a battery and Vin is supplied to one end of one resistor 16, whereas the other end of the resistor is grounded via the resistor 17. A resistor 18 is connected to the node between both the voltage dividing resistors and a diode formed with transistors 19 and 20 is connected the resistors. In other words, the emitter of the NPN transistor 19 is connected to the node (point P) between the resistors 16 and 17 via the resistor 18. The collector and base of the NPN transistor 19 are connected together and further connected to the emitter of the NPN transistor 20. The collector and base of the NPN transistor 20 are connected together and further connected via a PNP transistor 21 to the power supply terminal TN of a reference voltage VDD (e.g., 5V). Although the diode formed with the transistors 19 and 29 is employed according to this embodiment of the invention, these transistors may respectively be used as diode elements and with respect to the voltage VDD, any other reference voltage may also be used. Moreover, the resistor 18 may or may not be employed.

The transistor 21 together with PNP transistors 23 and 23 forms a current mirror circuit. The base of transistor 22 is connected to the collector of the transistor 21 and the base of transistor 20; the emitter of the transistor 22 is connected the bases of the transistors 21 and 23; and the collector of the transistor 22 is grounded. Further, the base of the transistor 23 is connected to the base of the transistor 21; the emitter of the transistor 23 is connected to the power supply terminal TN; and the collector of the transistor 23 is connected to the control line CL.

The battery voltage Vin is subjected to resistance type voltage division and so arranged as to led the current from the power supply terminal TN flow to the voltage dividing point P via an equivalent diode by means of the transistors 19 and 20. When the potential at the voltage dividing point P with respect to the battery voltage Vin comes to be smaller than VDD−4·VF, the supply of power to the discharge lamp is decreased with the effect of allowing the derating function to work as current (mirror current or return current) is caused to flow into the current mirror circuit and supplied as the current directed to the source with respect to the control line CL. In this case, VF means the same as VBE (base-to-emitter voltage) of each transistor and is synonymous with VF (a forward voltage drop) when a diode is used.

Figure 4:
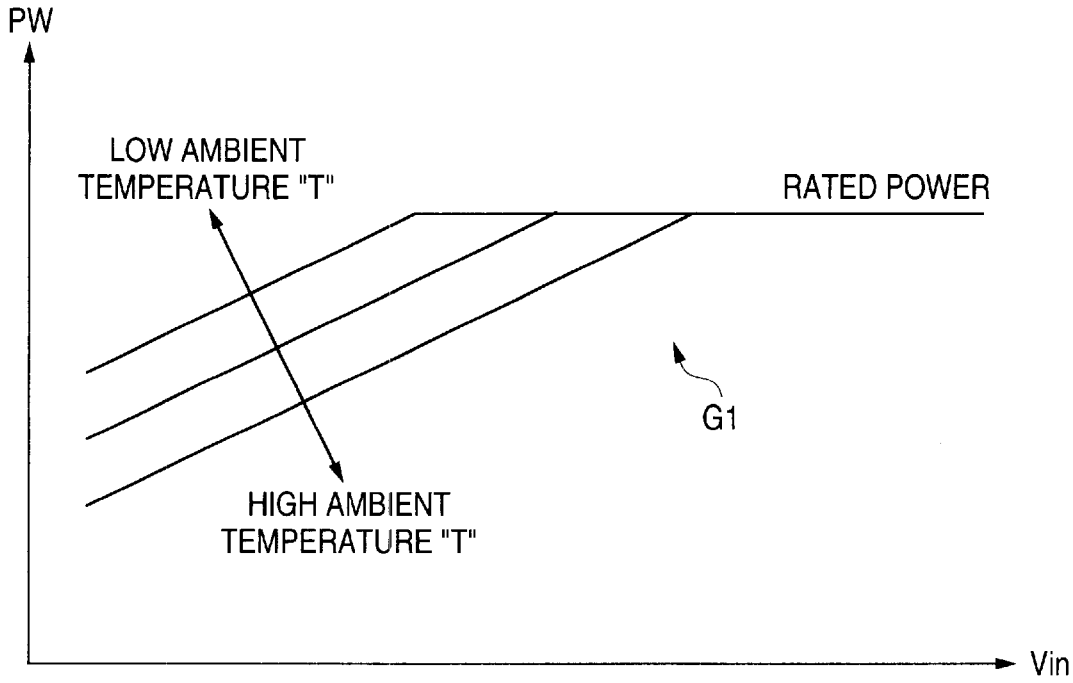
FIG. 4 shows a graphical representation showing the relation of output voltage to DC input voltage.

FIG. 4 is a schematic graphical representation showing derating control and the effect of the control on the ambient temperature, wherein the battery voltage Vin (power input to the lighting circuit) is taken on the horizontal axis, whereas the supply of power PW (output power) to the discharge lamp is taken on the vertical axis in order to illustrate the relation therebetween.

As shown by constant portions with graphic lines G1, though the PW has a constant value (rated power) in a manner irrelevant to the voltage value of the Vin in a certain range of the Vin, the PW value decreases as the Vin value decreases when the Vin value comes to be less than a threshold as shown by the folded portions of graphic lines. The threshold is large while the ambient temperature T is high and is small while the ambient temperature T is low.

More specifically, the ambient temperature T is relevant to the VF and as the VF indicates a predetermined voltage value at a predetermined ambient temperature, the mirror current starts to flow when the battery voltage Vin has the threshold or smaller (i.e., the potential at the voltage dividing point P comes to be smaller than VDD−4·VF) and the return current in the transistor 23 flows to the control line CL whereby to decrease the PW value. Then the mirror current increases as the Vin value lowers, so that a stronger derating action is taken.

Further, the VF rises as the ambient temperature T lowers, whereby the threshold decreases and the mirror current does not flow unless the battery voltage Vin lowers (there is created room for thermal breakdown and as the mirror current does not flow unless the battery voltage Vin falls, the derating control is hardly made effective). On the other hand, the VF lowers as the ambient temperature T rises, thus making the threshold grow larger, and the mirror current is caused to flow while the battery voltage Vin is not lower so much, whereby the derating control becomes effective quickly.

When the value of the DC input voltage Vin thus comes to have a preset threshold or smaller, the supply of power PW to the discharge lamp is decreased in proportion to a degree of reduction in Vin. Even though the Vin value remains unchanged, however, it is seen that control for decreasing the supply of power PW is performed when the ambient temperature T comes to have a preset threshold temperature or higher.

When the Vin value indicates the rated voltage, it is preferred to set the mirror current to prevent the mirror current from flowing however lower the VF is to ensure that predetermined power (the rated power) is always supplied to the discharge lamp according to the rated condition of the Vin.

Figure 5:
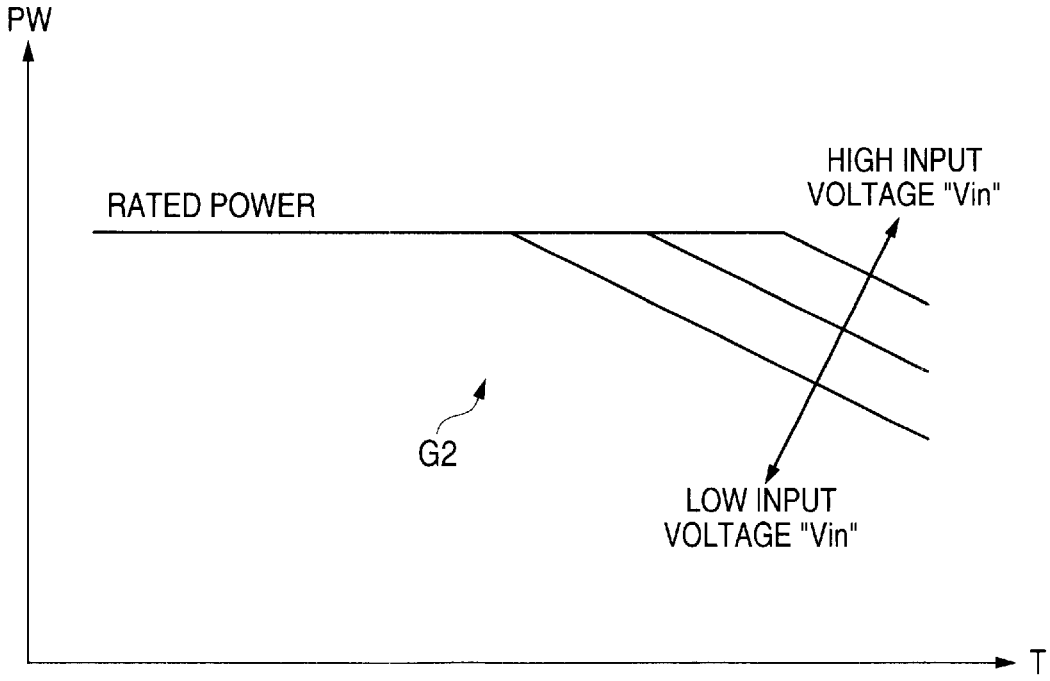
FIG. 5 shows a graphical representation showing the relation of the output voltage to the ambient temperature.

FIG. 5 shows the relation between the ambient temperature T taken on the horizontal axis and the supply of power PW on the vertical axis.

As shown by constant portions with graphic lines G2, PW has a constant value (the rated power) irrelevant to the ambient temperature T and when the temperature exceeds a certain threshold, the PW value lowers as the ambient temperature T rises as shown by folded portions of the graphic lines. Regarding the start points of the folded lines in the graph, the value is great when the Vin voltage value is high (right-hand position in FIG. 5) and is small when the Vin voltage value is low.

As shown in FIG. 4, the threshold concerned with the DC input voltage Vin is seen to increase since the VF lowers as the ambient temperature T rises and as shown in FIG. 5, the threshold concerned with the ambient temperature T is seen to decrease as the DC input voltage Vin lowers.

FIG. 6 shows an exemplary arrangement of performing derating control by adding to the power fine-adjusting circuit a circuit having the same circuit configuration as what is shown in FIG. 3 so as to supply current to the control line CL via the power fine-adjusting circuit. In this circuit 15B, only points different from the circuit 15A will be described below.

VDD as a reference voltage (shown by a symbol of constant-voltage power supply in FIG. 6) is supplied to the transistors 21 and 23 and simultaneously to a resistor 24 and a variable resistor 25. In this case, the VDD is supplied to one end of the resistor 24 and the other end thereof is grounded via the-variable resistor 25 (for finely adjusting the power setting).

The transistor 20 for use only as an equivalent diode is employed and the emitter of the transistor 20 is connected to the voltage dividing point P via the resistor 18. Thus, VF is decreased by one and this is concerned with the degree of power adjustment, irrespective of the number of them (i.e., may be two or four).

The basic portion of the power fine-adjusting circuit 14 includes a voltage buffer and the resistors 24 and 25. With reference to an operational amplifier 26 forming the voltage buffer, its non-inverted input terminal is connected to the node between the resistor 24 and the variable resistor 25 and the inverted input terminal is connected to the output terminal of the operational amplifier 26. Further, the output signal of the operational amplifier 26 is supplied via a resistor 27 to the control line CL.

This circuit configuration is useful when a control circuit including the above circuit is reduced to a custom IC (an integrated circuit). In other words, as the individual resistor has not absolute precision but relative precision, the resistance value of the resistor (in the custom IC) directly connected to the control line CL does not match the resistance value of the voltage dividing resistors (the resistors 16 and 17 that are provided outside the custom IC) of the battery voltage Vin. Consequently, there can be produced a divergence between the derating effect calculated on a desk and the actual effect. In order to avoid inconvenience like this, the mirror current is subjected to voltage conversion once and then changed to current by using the resistors in the custom IC. Therefore, voltage-to-current conversion is carried out by utilizing the operational amplifier 26 in the power fine-adjusting circuit 12 and as any existing circuit is usable as the above circuit, no increase in the circuit scale is accompanied thereby.

In the circuit 15B, the current flows into the current mirror circuit when the Vin value lowers and is subjected to voltage conversion when the current enters the voltage dividing resistors for finely adjusting power (see the node between the resistors 24 and 25) and then changed to current by the resistor 27 in the IC via the operational amplifier 26. When the current flows into the control line, the supply of power PW is decreased.

A description will now be given of power control in consideration of not only the lowering degree of the DC input voltage Vin but also the time during which the DC input voltage Vin as a derating control parameter lowers.

In the case of a vehicle, for example, the severest condition in terms of temperature exists while the discharge lamp is in the on-state after the vehicle engine is stopped (in such a condition that an alternator is not working). In case where the discharge lamp is compelled to operate at low voltage for hours while the supply of voltage from the battery is gradually lowering, current consumption increases, thus causing the temperature to rise. Particularly when the voltage capable of maintaining the on-state of the discharge lamp is low or when the discharge lamp is highly competent in keeping its on-state (capable of keeping its on-state at a lower voltage), its thermal condition becomes severe. Further, the discharge lamp is turned off when the discharge lamp is unable to keep its on-state as the voltage lowers. As the battery voltage recovers then, the discharge lamp is turned on again and the voltage gradually lowers in cycle. Finally, the battery voltage lowers up to the condition in which the discharge lamp is unable to keep its on-state any longer.

On the assumption that while the discharge lamp is kept lighting, it is forgotten to turn the discharge lamp off, a severe condition is imposed on the lighting circuit thermally and even in such a case as this, the circuit is needed to be prevented from undergoing thermal destruction. In other words, in case where the lowering of the DC input voltage (battery voltage) lasts for hours, there is caused an increase in probability of bringing a harmful influence such as the difficulty of starting the vehicle engine, to say nothing of affecting the operation of electrical fitments. Consequently, this situation has to be avoided as much as possible.

Therefore, it is preferred to plan self-defense against circuit failure because of any thermal factor by not feeding the power so as to maintain the brightness of the discharge lamp at a proper level with respect to the lowering of the input voltage for hours but decreasing power consumption as the lowering of the input voltage lasts for hours or ultimately turning off the discharge lamp.

Consequently, when the DC input voltage falls to the threshold or lower, the power control is performed so that the supply of power to the discharge lamp lowers as the lowering degree increases and as the time causing the fall of the voltage to the threshold or lower drags on. In other words, the temperatures of electronic parts and the circuit do not rise immediately after the lowering of the input voltage but gradually rises after the lowering thereof, whereby the temperature rise increases as the lowering of the input voltage lasts for hours. Therefore, effective control inclusive of a time factor is performed by raising the derating degree while suppressing the power consumption and further by reducing the power consumption to zero (switching the lamp off) as the lowering condition lasts for long.

Figure 7:
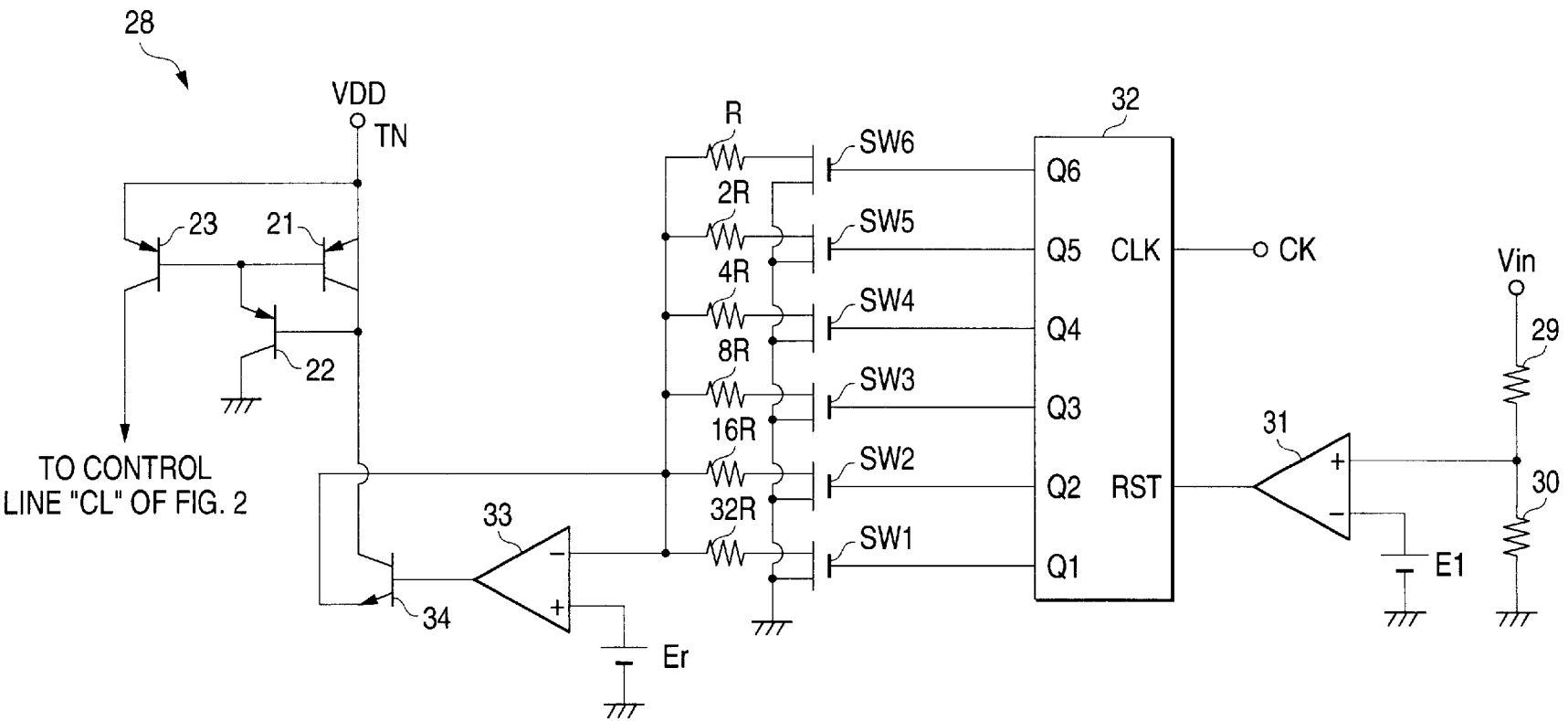
FIG. 7 shows a circuit diagram illustrating power control in proportion to the lower time of DC input voltage.

FIG. 7 shows the principal part of a circuit configuration 28 by reference to the control circuit arrangement of FIG. 2.

The DC input voltage Vin is divided and detected by resistors 29 and 30 before being supplied to the positive input terminal of a comparator 31. To the negative input terminal of the comparator 31, a predetermined reference voltage E1 (shown by a symbol of a constant-voltage power supply), the voltage being equivalent to a threshold with respect to the detected value of Vin.

When the Vin falls to the threshold or lower, a counter 32 is provided so as to measures the lowering time and a clock signal CK from a signal generating circuit (not shown) is supplied to the clock-signal input terminal CLK of the counter 32. Moreover, the output signal of the comparator 31 is supplied to the reset terminal RST of the counter 32, which is reset by the H (high) level signal sent out of the comparator.

Analog switches SW1 to SW6 (shown by simplified symbols in FIG. 7 and FETs are used, for example) are provided at the respective output terminals (Q1 to Q6) of the counter 32. To the respective analog switches, resistors (R, 2R, 4R, 8R, 16R and 32R and the number added to R indicates a proportional value) having a resistance ratio of the second power are attached. In other words, the analog switch SWX (X=1 to 6) that is turned on/off by the output signal of the terminal WX (X=1 to 6) is provided to each terminal. When Y=2^(6−X) (^ represents power) is written down, a resistor YR (however, 1R=R) is attached to the output-side terminal (the terminal not on the grounding side out of the non-control terminals) of the analog switch SWX (X=1 to 6). These six resistors are connected in parallel to each other and terminal commons to the six resistors are respectively connected to the negative input terminal of an amplifier 33 and the emitter of an NPN transistor 34.

A predetermined reference voltage Er (shown by a symbol of a constant-voltage power supply) is supplied to the positive input terminal of the amplifier 33 and the output terminal of the amplifier is connected to the base of the transistor 34. In this case, Er may be the voltage different from E1.

The collector of the transistor 34 is connected to the power supply terminal TN of the reference voltage VDD via the PNP transistor 21 and the base of the PNP transistor 22 is connected to the respective collectors of the transistors 21 and 34. Further, the emitter of the transistor 22 is connected to the common base of the transistors 21 and 23, whereas the collector of the transistor 22 is grounded. Moreover, the emitter of the PNP transistor 23 is connected to the power supply terminal TN and the collector of the transistor 23 is connected to the control line CL (see FIG. 2).

When the value of the DC input voltage Vin lowers and when the output signal of the comparator 31 has an L (low) level, the counter 32 starts to calculate the clock signal CK. The value of the whole current flowing through the analog switches SW1 to SW6 increases as the time grows longer after the calculation is started (the reason for this is that the resistance value is set smaller as the output grade of the counter 32 rises as stated above). More specifically, the current value is prescribed by 'reference voltage Er/combined resistance value' (e.g., the parallel combined value of the whole resistor is found while all of the analog switches are held ON) and the current is caused to flow into the control line CL (toward the source) by the current mirror circuits of the transistors 21 to 23 and the power fed into the discharge lamp lowers as the current value increases. In other words, as the elapsed time increases after the input voltage Vin has a level equal to or lower than the threshold, the control current value increases such that the control is performed so as to decrease the supply of power to the discharge lamp.

Although the number of analog switches and that of resistors are the same with respect to the six outputs of the counter 32 according to this embodiment of the invention, the resolution of the derating control can needless to say be raised by increasing the number of them.

Figure 8:
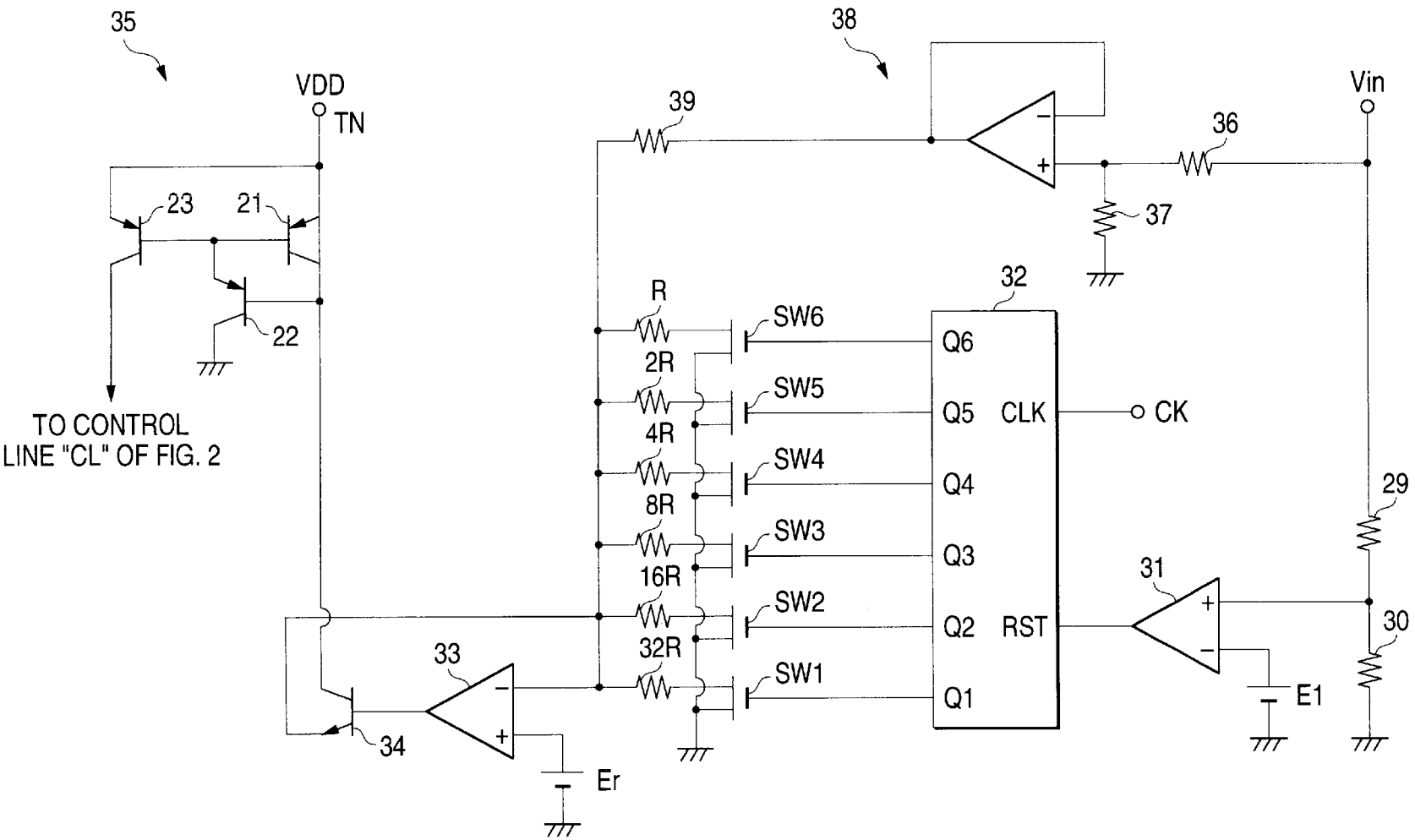
FIG. 8 shows a circuit diagram illustrating power control by taking the detection of the lowering of the DC input voltage into consideration with respect to the configuration of FIG. 7.

FIG. 8 shows a circuit configuration 35 wherein the lowering degree of the Vin itself (the lowering degree with the threshold as a reference) is added to the lowering time when the Vin is equal to or lower than the threshold as factors for determining the strength of the derating control.

What makes FIG. 8 different from FIG. 7 is that by adding the detecting portion concerned with the lowering of the Vin, its output is supplied as an input to the amplifier 33. In other words, the Vin is fed into a buffer 38 via resistors 36 and 37 and the output of the buffer is supplied via a resistor 39 to the negative input terminal of the amplifier 33. In this case, an operational amplifier is used as the buffer 38 and a detected Vin signal (a resistance type potential dividing signal) is supplied to the non-inverted input terminal of the buffer, the inverted input terminal and the output terminal being connected together.

In this circuit 35, when the Vin lowers without considering the derating control using the detection of the lowering time of the Vin, current corresponding to the lowering of the voltage flows into the resistor 39 and the power fed into the discharge lamp is affected via the control line CL (i.e., the power thus supplied decreases as the lowering of Vin increases). This control function is added to the derating control using the detection of the lowering time of the Vin and the reason for this is that the current in the resistor 39 is combined to the current by means of the group of resistors (R to 32R) at the input stage of the amplifier 33. In this case, the supply of power to the discharge lamp is controlled in accordance with the lowering and lowering time of the Vin.

Figure 9:
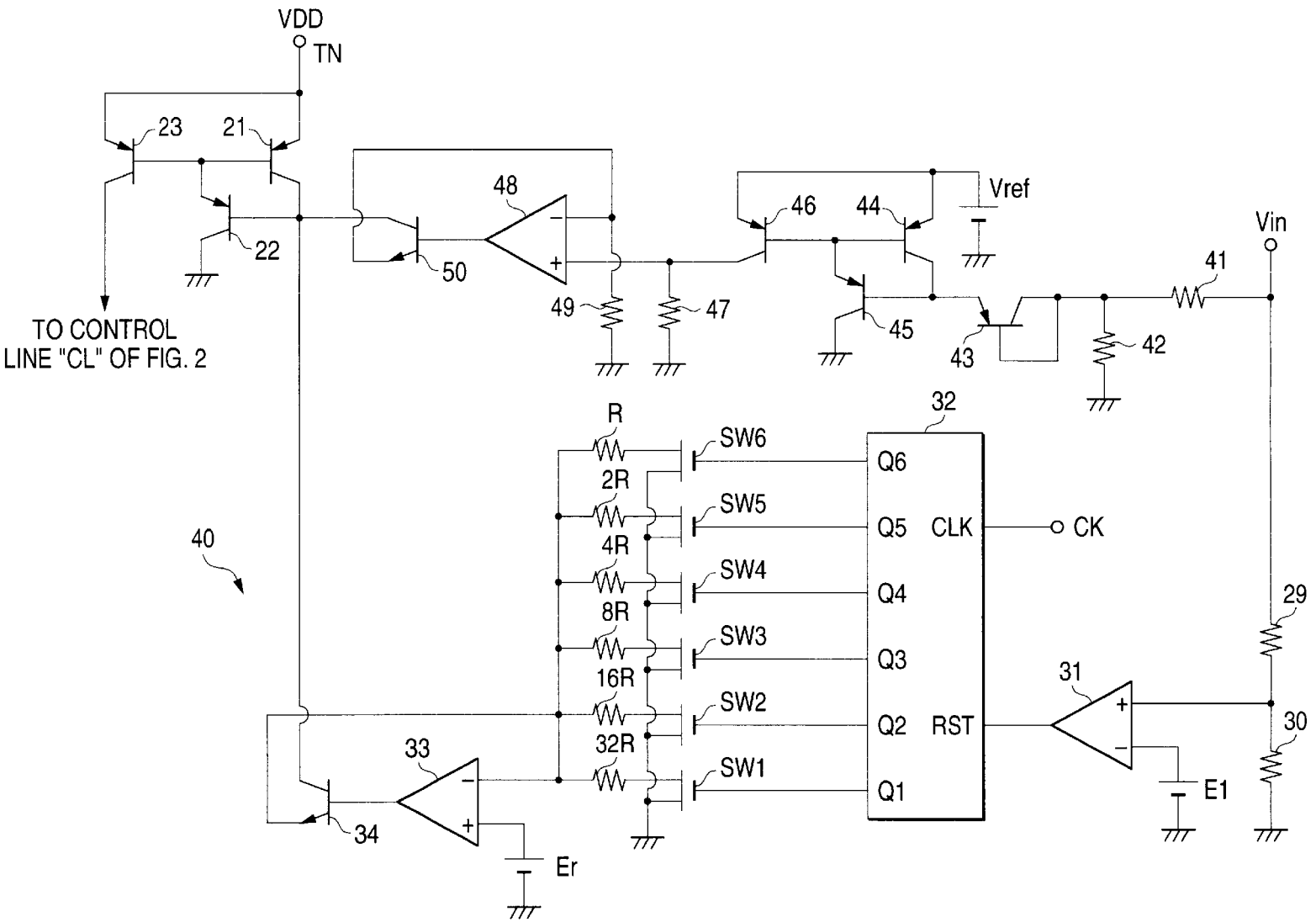
FIG. 9 shows a circuit diagram illustration power control in consideration of the effect of the ambient temperature.

FIG. 9 shows a circuit configuration 40 when the effect of the ambient temperature on the circuit is taken into consideration.

In place of the Vin detecting portion in FIG. 8, a circuit similar in configuration to what is shown in FIG. 3, wherein the portions concerned with the detection of lowering time of Vin and the power control are the same as those shown in FIGS. 7 and 8.

According to this embodiment of the invention, the input voltage Vin is divided by resistors 41 and 42 and the node of both resistors is connected to the collector of a PNP transistor 43. Further, the base of the transistor 43 is connected to its collector and its emitter is connected to the collector of PNP transistor 44 and to the base of a PNP transistor 45.

The base of the transistor 44 and the base of a transistor 46 are connected together and the emitters of both the transistors are connected to a reference power supply VREF (shown by a symbol of a constant-voltage power supply). The emitter of the transistor 45 is connected to the bases of the transistors 44 and 46, whereas its collector is grounded. Further, a current mirror circuit is formed with these transistors 44 and 46.

The collector of the transistor 46 is grounded via a resistor 47 and connected to the positive input terminal of an amplifier 48 and a resistor 49 is attached to the negative input terminal of the amplifier, one end of the resistor being grounded.

An NPN transistor 50 is provided at the output stage of the amplifier 48 and the output of the amplifier 48 is supplied to the base of the transistor 50. Further, the emitter of the transistor 50 is connected to the negative input terminal of the amplifier 48 and the collector of the transistor 50 is connected to the collector of the transistor 21 and to the base of the transistor 22.

In this circuit 40, a transistor is used as an element for monitoring the ambient temperature and when the resistance type potential dividing value of the Vin is lower than a threshold VREF−3·VF, current flows into the current mirror circuit with the transistors 44 to 46 and the supply of power to the discharge lamp is affected thereby through the circuit at the following stage of the amplifier 48 (i.e., the VF lowers as the ambient temperature T uses whereby to increase the threshold, so that the effectiveness of the derating control is advanced). Moreover, the derating control corresponding to the lowering time of Vin is added. With regard to the supply of power to the discharge lamp, adjustment of the lowering degree and balance may be made by setting or altering each of the reference voltage and resistance values.

Although the supply of power to the discharge lamp has been so arranged as to be gradually decreased according to the situation involved according to the embodiments of the invention as described so far, it is preferred to positively turn off the discharge lamp in case where the lowering of Vin lasts for hours. In other words, in such a condition that the Vin remains at its threshold or lower within a certain length of time, the derating control is performed with the lowering and lowering time of Vin and the ambient temperature as control parameters but in case where the time during which the input voltage Vin falls to the reference voltage or lower lasts for a predetermined reference time (hereinafter called the 'first reference time') or greater, the supply of power to the discharge lamp is cut off.

Figure 10:
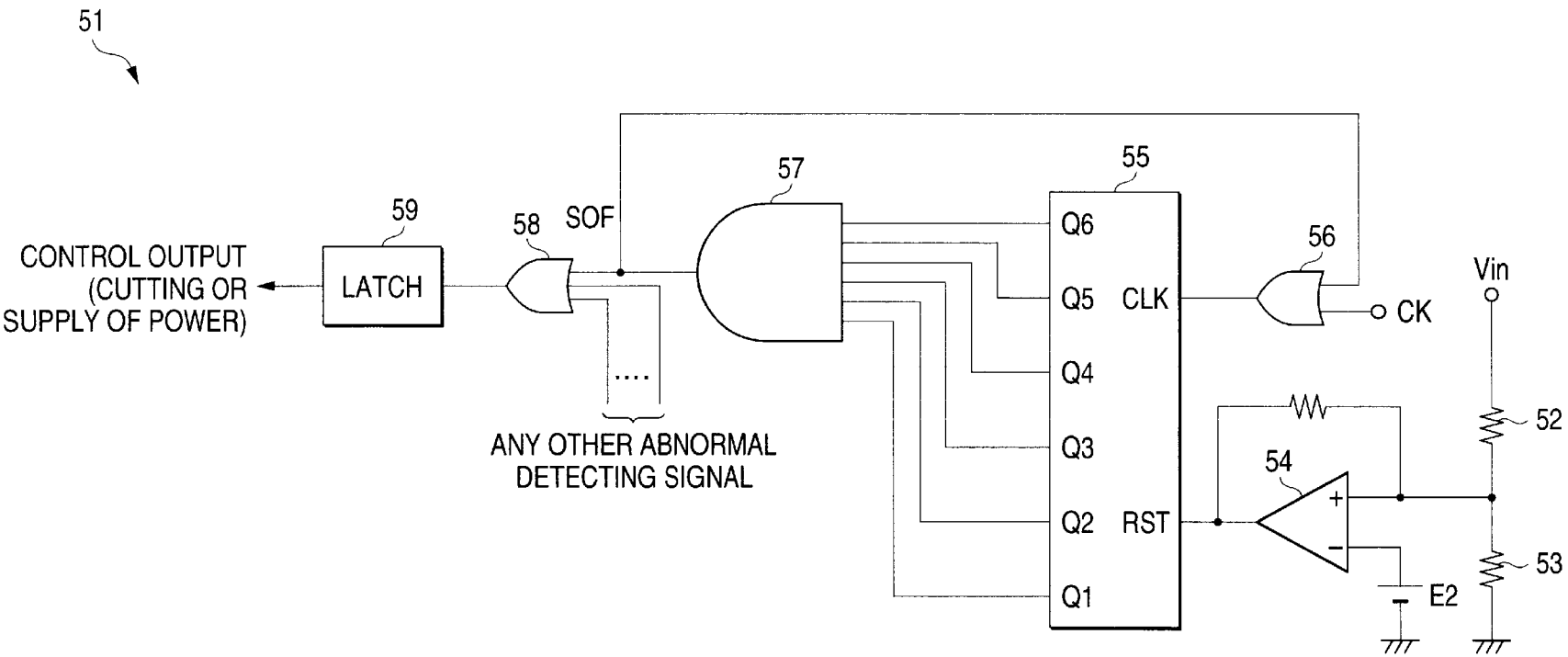
FIG. 10 shows a circuit diagram illustrating the off-condition of a discharge lamp when the lowering of the DC input voltage is conspicuous.

FIG. 10 shows a circuit configuration 51.

The detected voltage obtainable from voltage dividing resistors 52 and 53 with respect to the Vin is supplied to the positive input terminal of a comparator 54 for comparing the voltage with a reference voltage E2.

A counter 55 is provided for measuring the lowering time (duration) when the detected value of Vin falls to the reference voltage E2 or lower and a clock signal CK from a signal generating circuit (not shown) via a 2-input OR gate 56 to a clock signal input terminal CLK. As the output signal of the comparator 54 is supplied to the reset terminal RST of the counter 55, the counter is reset by the H (high) level signal fed by the comparator.

The outputs (outputs of terminals Q1 to Q6) of the counter 55 are fed into a multi input AND gate 57 and the output signal of the gate makes a control output. In other words, that signal is a signal (hereinafter called 'SOF') for reducing the supply of power to the discharge lamp to zero and sent to an OR gate 58 at the following stage and simultaneously to the OR gate 56 (whereby when the signal SOF remains at the H level, the counter 55 will not accept the clock signal CK as the output signal of the OR gate 56 has the H level).

The OR gate 58 is a multi input OR gate and arranged so that in addition to the signal SOF, a signal is supplied from an abnormality detecting circuit (or abnormality deciding·diagnosing circuit) (not shown), whereby when any one of these signal has the H level, the gate concerned outputs such a H level signal, which is held in a latch circuit 59 at the following stage. Then the supply of power to the discharge lamp is cut off by the signal thus held. As to the power cutting, there are various known forms including, for example, cutting off the supply of power to the lighting circuit by using a switch means such as a relay, interrupting the control of the lighting circuit, stopping the operation of the DC-DC converter and shutting down the DC-AC converter circuit (hence, the description of these forms will be omitted).

In this circuit 51, the detected value of Vin is compared with E2 by the comparator 54 and when the output signal of the comparator has the L level, the counter 55 starts the calculating operation. In this case, the reference voltage E2 may be set at the same value as that of E1 or at a value different from that of E1.

When the predetermined time (the first reference time) elapses after the calculation of the clock signal CK is started, the output of the counter 55 at each grade has the H level and the signal SOF has also the H level. The predetermined time in this case is regulated by the frequency of the clock signal CK and conforms to the basic period of the CK×63 (second) according to this embodiment of the invention.

As the signal SOF having the H level is sent to the OR gates 56 and 58 and held by the latch circuit 59, the supply of power to the discharge lamp is reduced to zero and the discharge lamp is turned off.

With this arrangement, the use of the clock signal CK and the counter commonly with the circuit arrangements in FIGS. 7 to 9 makes the circuit configuration simpler because the same CK and counter are usable.

As set forth above, the signal SOF indicating the H level is made a turn-off designating signal and though the discharge lamp is turned off by this signal, the following forms for dealing with the situation thereafter may be enumerated.

(1) A form of not allowing the discharge lamp to be turned on unless the power is supplied thereto again even though the input voltage Vin recovers to have the former voltage level.

(2) A form of allowing the discharge lamp to be turned on again when the input voltage Vin recovers to have the former voltage level.

First, the form (1) is such that the discharge lamp is kept in the off condition until the user feed power thereto again after the discharge lamp is turned off by latching the H level of the signal SOF. Even though the value of the voltage Vin is recovered, the discharge lamp is not turned on after it is turned off. On the assumption that the discharge lamp ultimately goes off because the battery voltage gradually lowers as it has been forgotten to turn off the vehicle discharge lamp, for example, the battery voltage rises toward the former level even though the alternator does not operate. With the rising of the voltage, for example, even though the battery voltage exceeds E2, immediately return to the resetting of the discharge lamp causes the battery voltage to lowers due to turning on the discharge lamp and the same cycle as mentioned above may be repeated. In order to prevent the battery from being consumed more than necessary and to set the circuit temperature rise in a range posing no problem, the discharge lamp is kept in the off condition until the operation of feeding the power (i.e., turning on the lighting switch again) is performed over again.

With regard to the form (2), the discharge lamp is turned on again when the Vin level is recovered without waiting for the refeeding of power after the discharge lamp is turned off. However, the same problem as mentioned above may arise after return to the resetting of the discharge lamp in case where the reference voltage is set at the same value as that of E2. Consequently, the following matters are adopted.

(A) To set a reference voltage higher than the reference voltage E2 for making the cut-off decision as the reference voltage (hereinafter called 'E3') for making a reset decision; and (B) To decide whether the recovery of the Vin to the reference voltage or higher is maintained over a predetermined reference time (hereinafter called the 'second reference time' and E3=E2 may be set).

One of the (A) and (B) may be adopted; that is, a comparator means is used to detect whether the Vin reaches E3 whereby to decide the resetting of the discharge lamp or a timer means is used for deciding the recovery of the Vin by the time required therefor whereby to decide the resetting of the discharge lamp by comparing the time required with the reference time; in this case, (A) and (B) can be adopted simultaneously (E3>E2 is set).

Figure 11:
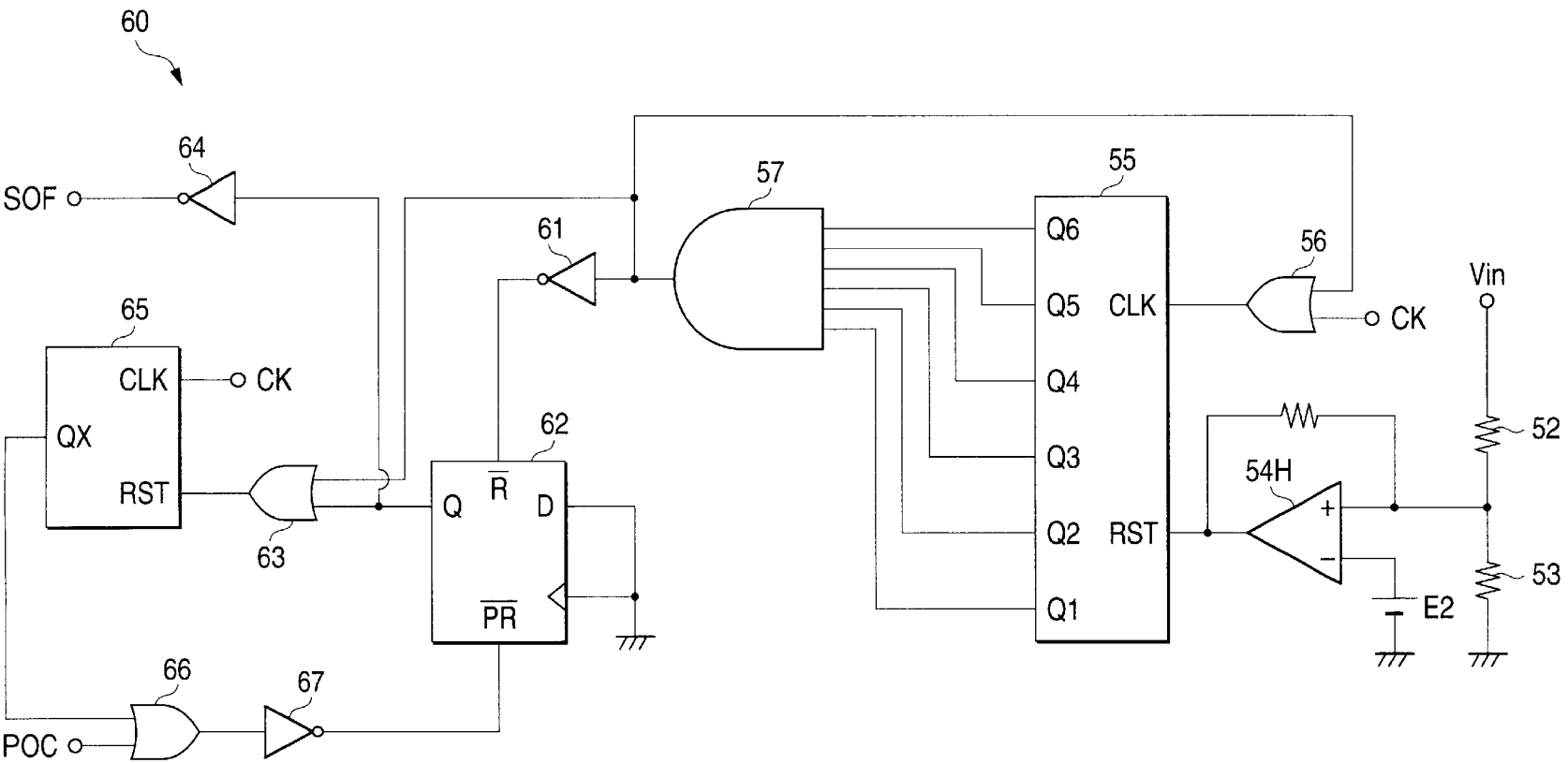
FIG. 11 shows a circuit diagram illustrating the resetting of the discharge lamp at the recovery of the DC input voltage.

FIG. 11 shows a circuit configuration 60 wherein the combination of (A) and (B) is adopted and the difference between the circuit configurations shown in FIGS. 10 and 11 is as follows.

In place of the comparator 54, a hysteresis comparator 54H is employed. In other words, the reference voltage E2 at the time the output signal of the comparator changes from the H level to the L level differs from the reference voltage E3 at the time the output signal thereof changes from the L level to the H level; namely E2<E3.

A counter 65 is provided as a timer means and when the output of the counter has the H level, a D flip-flop 62 is preset and the signal SOF comes to have the L level as logical NOT with respect to the output Q of the flip-flop.

In reference to the circuit configuration, the output signal of the multi input AND gate 57 is sent via a NOT (logical NOT) GATE 61 to the reset terminal R of the D flip-flop 62 and also to a 2-input OR gate 63. In this case, the D flip-flop 62 is provided with a preset terminal PR and a reset terminal R of L active input (shown with over lines in FIG. 11) with a D input terminal and a clock signal input terminal being grounded.

The output signal Q of the D flip-flop 62 is sent to the 2-input OR gate 63 and becomes the signal SOF via the NOT gate 64.

The output signal of the OR gate 63 is supplied to the reset terminal RST of the counter 65 and the clock signal CK from a signal generating circuit (not shown) is sent to the clock signal input terminal CLK of the counter 65. Further, the output (output signal of a terminal QX) of the counter 65 is supplied to one input terminal of a 2-input OR gate 66. A POC (Pulse On Clear) signal having narrow width and generated at the time the circuit rises is supplied to the other input terminal of the OR gate 66 and the output signal of the OR gate 66 is supplied via a NOT gate 67 to the preset terminal PR of the D flip-flop 62. Thus, when the output from the terminal QX of the counter 65 has the H level or when the POC signal is generated (at the time of initialization), the D flip-flop 62 is preset and its output Q comes to have the H level (the signal SOF is at the low level).

Figure 12:
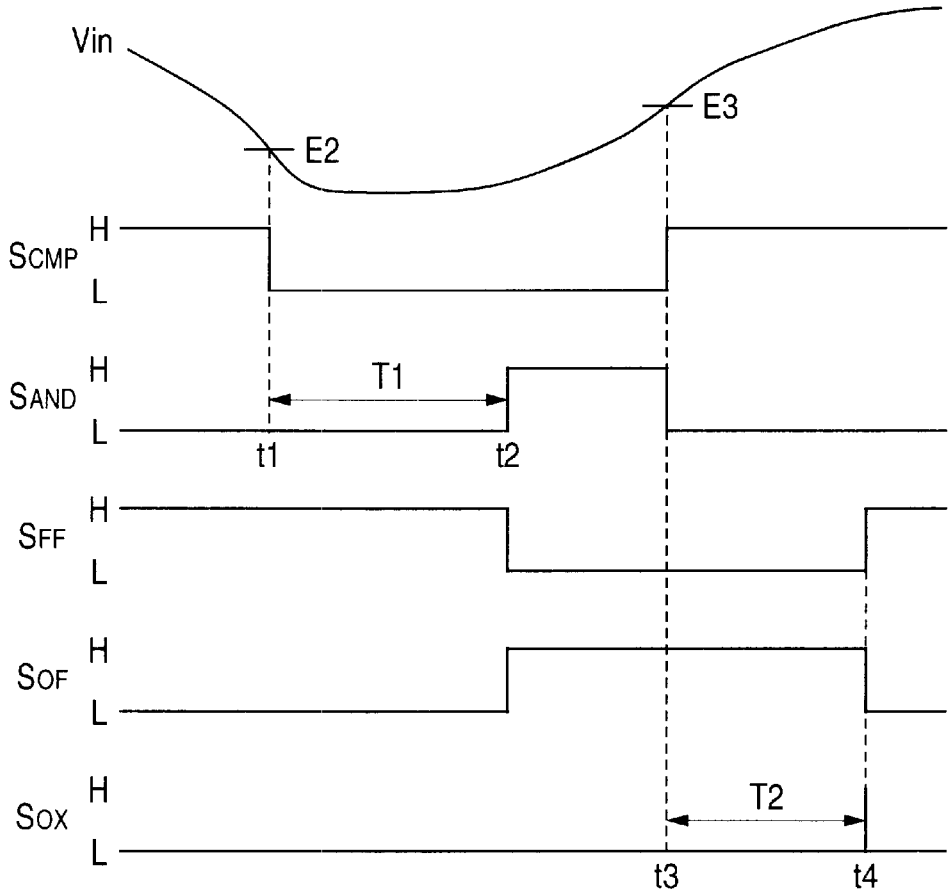
FIG. 12 shows a diagram showing waveforms of the principal part in the configuration of FIG. 11.
Figure 13:
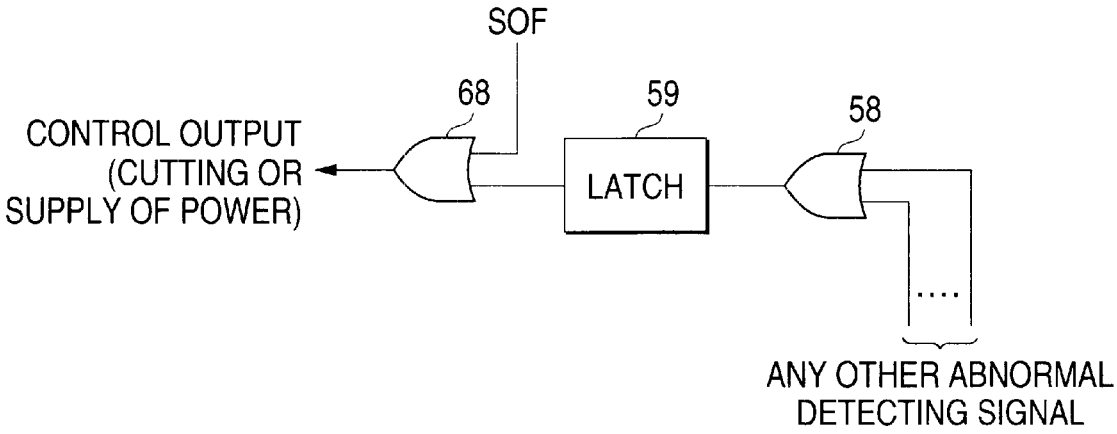
FIG. 13 shows a circuit diagram illustrating a circuit configuration for not holding the off-condition of the discharge lamp.

FIG. 12 is a schematic diagram showing a signal waveform of each portion and timing, and symbols shown therein are as follows.

SCMP=output signal of the comparator 54H.

SAND=output signal of the AND gate 57.

SFF=output signal Q of the D flip-flop 62.

SQX=output signal of the counter 65.

In FIG. 12, a period T1 (time t1 to t2) is equivalent to the first reference time and a period T2 (time t3 to t4) to the second reference time, and H and L indicates high and low levels, respectively.

When the input voltage is normal (Vin>E2), first, the SCMP has the H level; the SAND has the L level; SFF has the H level; and the SOF and SQX have the L level (the supply of power continues).

When the Vin lowers to E2 or lower (Vin<E2), the SCMP comes to have the L level (time t1) and after the first reference time T1 elapses, the SAND is at the H level (time t2), the SFF at the L level and the SOF at the H level (cut-off of the supply of power).

When the Vin recovers and rises, Vin>E3 at time t3 (SCMP at the H level and the SAND at the L level) and before the second reference time T2 elapses, the SFF is at the L level and SOF at the H level. When the reference time T2 elapses as the timing operation of the counter 65 progresses, the SQX rises to have the H level temporarily (time t4), which is sent to the D flip-flop 62 via the OR gate 66 and the NOT gate 67, whereby the SFF comes to have the H level and the SOF has the L level (resupply of power).

Since the signal SOF is not latched as shown in the form (1) according to this embodiment of the invention, a 2-input OR gate 68 is provided at the following stage of the latch circuit 59 and the output signal of the latch circuit 59 (with the SOF removed from the input of the OR gate 58) and the signal SOF are supplied to the OR gate 68 whereby to use the output signal of the gate 68 for cut-off, maintaining or refeeding control about the supply of power to the discharge lamp.

When the Vin recovers to E3 or higher and while this condition is maintained over the reference time T2 after the supply of power to the discharge lamp is cut off by setting the reference voltage E3 which is higher than the reference voltage E2 at the time the lowering of Vin is detected, the discharge lamp can be turned on and maintained by permitting turning on the discharge lamp again in case where the resetting of Vin is anticipated. This is a case where it is assumed that the voltage recovers spontaneously so that the discharge lamp can be turned on again since the DC input voltage lowers temporarily, for example.

However, there can be a form of varying the DC input voltage as the DC input voltage recovers in addition to the form of keeping the set voltage value constant at all times over the reference time T2. In the case of a vehicle discharge lamp, for example, the battery voltage is assumed to recover almost nearly to the rated voltage because the user becomes aware of having forgotten to turn off the discharge lamp and starts the engine by operating the alternator. In this case, it is not wise to set T2 for a fixed time (as the required resetting time becomes longer) but preferable to set shorter T2. In other words, after the supply of power to the discharge lamp is cut off, the length of such a set reference time (T2) to be decided is preferably shorten when the recovery of the DC input voltage is anticipated and the degree of recovery (rising) is high.

A reference voltage E4 set at a level higher than the reference voltage E3 and close to the rated voltage Vin is provided and the reference time T2 is so control as to be shortened when the Vin level recovers to reach E4, whereby it is possible to reset the discharge lamp in a short time in comparison with the arrangements as described above.

Figure 14:
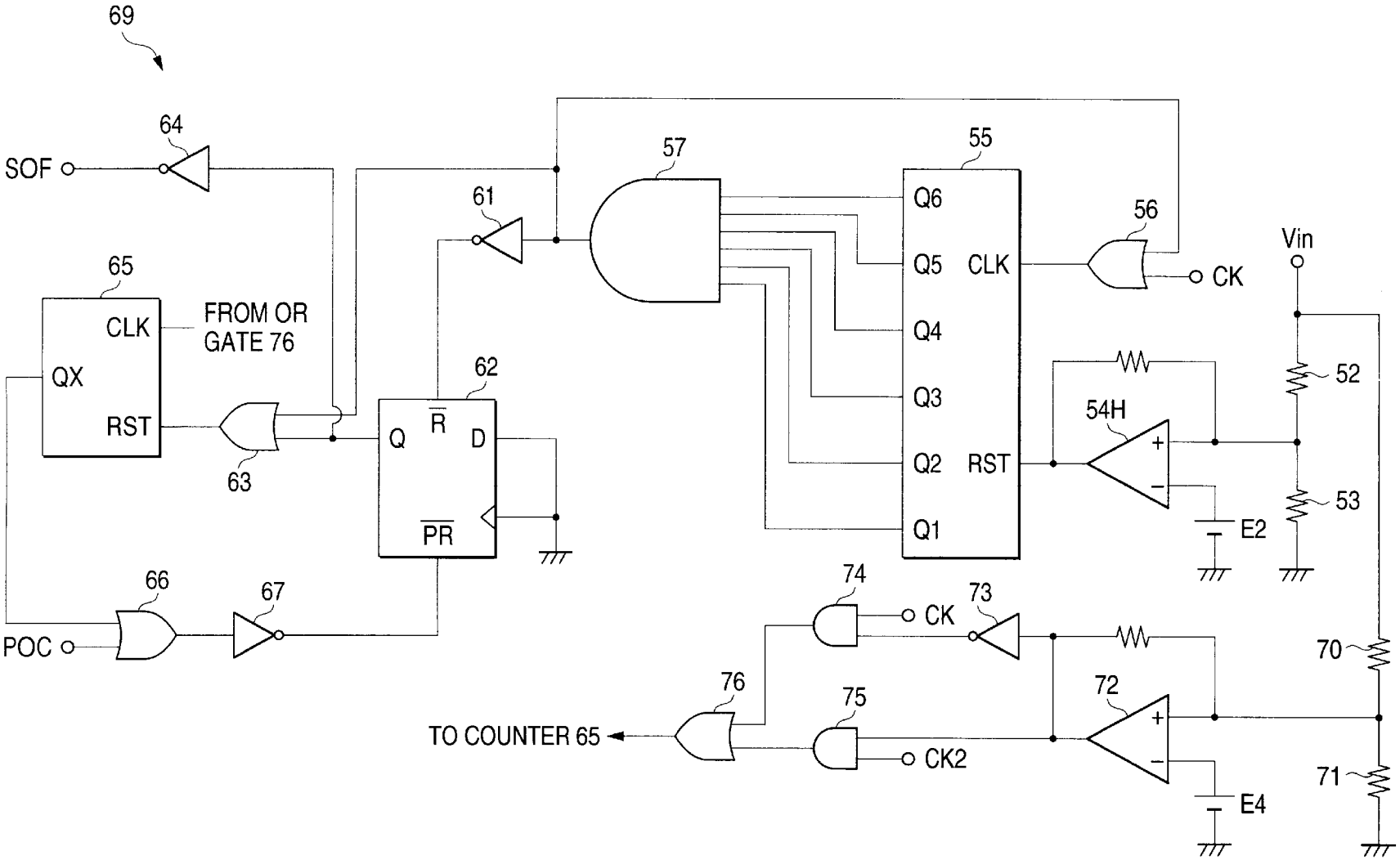
FIG. 14 shows a circuit diagram showing a configuration for varying the reference time concerned with making a decision on the resetting of the discharge lamp.

FIG. 14 shows a circuit configuration 69 and the difference between the circuit configurations shown in FIGS. 11 and 14 is as follows.

A signal CK2 having a frequency higher than that of the clock signal CK supplied to the counter 65 is prepared and both of these signals are selectively supplied according to a signal from a hysteresis comparator 72 (while the Vin remains low, the CK is used and as the Vin rises, the CK2 is used).

In this circuit configuration, the detected value of Vin that is obtainable from voltage dividing resistors 70 and 71 is supplied to the positive input terminal of the hysteresis comparator 72 and reference voltage E4 (shown by a symbol of a constant-voltage power supply) is supplied to the negative input terminal thereof. In other words, the H level signal is outputted when the detected value is equal to or higher than E4.

Of the clock signals CK and CK2, the CK is sent via a 2-input AND gate 74 to one input terminal of a 2-input OR gate 76. The output signal of the comparator 72 is supplied via a NOT gate 73 to an AND gate 74.

On the other hand, the signal CK2 is sent via a 2-input AND gate 75 to the other input terminal of the 2-input OR gate 76. The output signal of the comparator 72 is supplied to the AND gate 75.

The output signal (CK or CK2) of the OR gate 76 is supplied to the clock signal input terminal CLK of the counter 65 and counted therein.

In this circuit configuration, the operation until the Vin recovers to exceed E3 is the same as that in FIG. 11 and the L level signal sent out of the hysteresis comparator 72 is inverted by the NOT gate 73 and supplied to the AND gate 74 whereby to select the signal CK.

When the Vin recovers to E4 or higher, the H level signal sent out from the hysteresis comparator 72 is supplied to the AND gate 75 whereby to select the signal CK2. As the CK2 is a clock signal having a frequency high than that of the CK, the operation of the counter 65 is quickened and the time required to reset the discharge lamp is shortened accordingly (this is equivalent to the shortage of the reference time T2).

The reason for the use of a hysteresis comparator as the comparator for use in deciding the level of E4 is to prevent the signals CK and CK2 from being switched from one to the other in the vicinity of the threshold and this makes the hysteresis width extremely small.

Thus, the substantial modification of the circuit can be avoided by setting the threshold for the recovery of Vin and switching the frequency of the clock signal in response to the result of level comparison.

The idea of varying the length of the decision-making reference time according to the Vin level is applicable to the first reference time. In this case, the reference time for making a decision on cutting the voltage is only needed to be shortened as the lowering degree of Vin increases. In other words, as the thermal condition because of heat generation tends to become severe because the input current is enlarged as the Vin lowers, it is safe to turn off the discharge lamp by cutting off the supply of power to the discharge lamp at early timing when the Vin considerably lowers.

Figure 15:
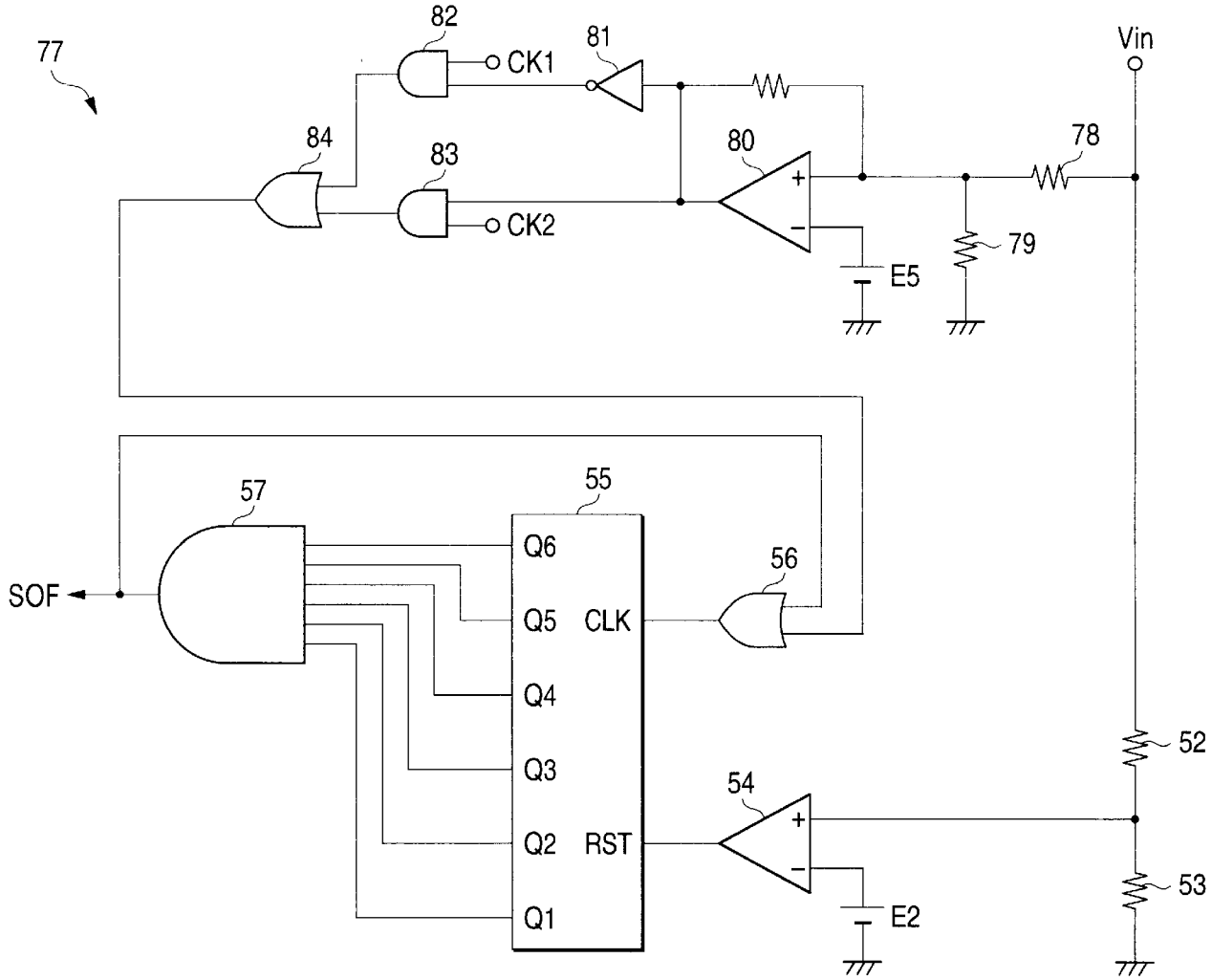
FIG. 15 shows a circuit diagram showing a configuration for varying the reference time concerned with making a decision on the cutting of the feeding of power.
Figure 16:
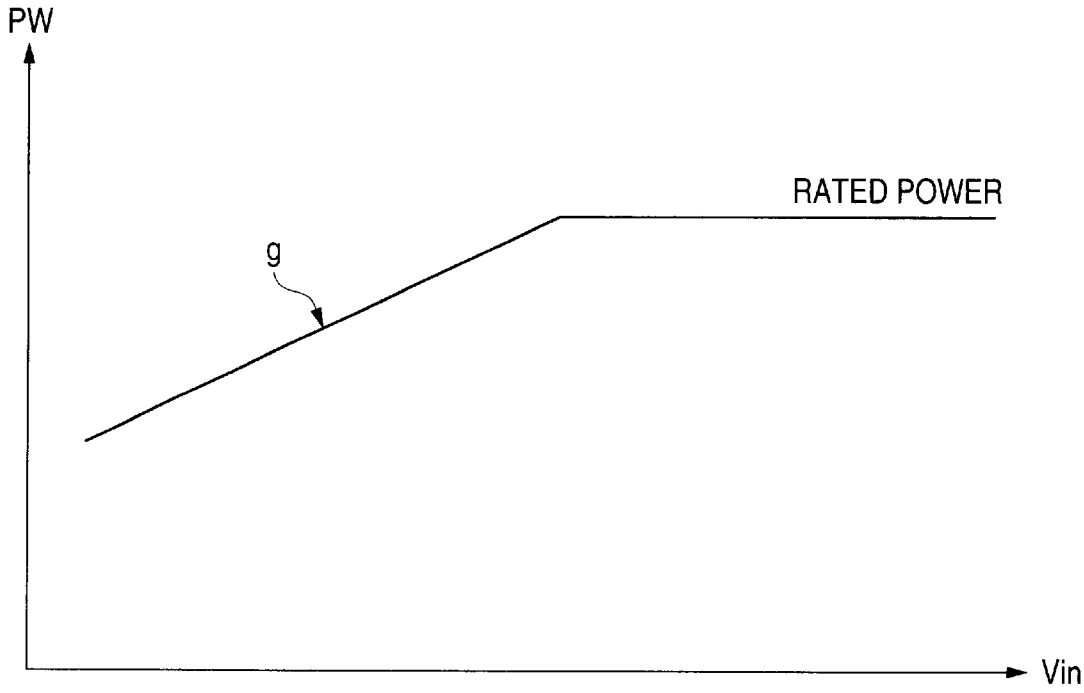
FIG. 16 shows a graphical representation illustrating the problems heretofore raised.

FIG. 15 shows a circuit configuration 77 and the difference between the circuit configurations shown in FIGS. 10 and 15 is as follows.

A signal CK1 having a frequency higher than that of the clock signal CK2 supplied to the counter 55 is prepared and both of these signals are selectively supplied according to a signal from a hysteresis comparator 80 (while the Vin remains high, the CK2 is used and as the Vin lowers, the CK1 is used).

In this circuit configuration, the detected value of Vin that is obtainable from voltage dividing resistors 78 and 79 is supplied to the positive input terminal of the hysteresis comparator 80 and compared with a reference voltage E5. Further, the output signal of the comparator is sent to a 2-input AND gate 82 via a NOT gate 81 and the output signal thereof is sent to a 2-input AND gate 83.

The signal CK1 from a signal generating circuit (not shown) is supplied to the 2-input AND gate 82 and an AND operation is carried out between the signal and a signal from the NOT gate 81, the result being sent to one input terminal of a 2-input OR gate 84.

Further, the signal CK2 from a signal generating circuit (not shown) is supplied to the 2-input AND gate and an AND operation is carried out between the signal and an output signal from the comparator 80, the result being sent to the other input terminal of the 2-input OR gate 84.

Then the output signal of the OR gate is sent to the OR gate 56 and an OR operation is carried out between the signal and the signal SOF, the result being sent to the clock signal input terminal CLK of the counter 55.

According to this embodiment, when the Vin is greater than ES, the H level signal sent out of the hysteresis comparator 80 is supplied to the AND gate 83 whereby to select the signal CK2.

When the Vin lowers to E5 or lower, the L level signal sent out of the hysteresis comparator 80 is inverted by the NOT gate 81 and the supplied to the AND gate 82 whereby to select the signal CK1. As the signal CK1 is a clock signal having a frequency higher than that of the CK2, the operation of the counter is quickened and the time required up to cutting the supply of power is shortened accordingly (this is equivalent to the shortage of the reference time T1).

On the assumption that the values of E5 and E2 are equal to each other with respect to the reference voltage, the output signal level can be switched by input voltage lower than E2 in the comparator 80 by setting each resistance value so that the resistance type potential dividing value of the Vin applied to the comparator 80 is greater than that of the comparator 54 (i.e., provided the setting of the voltage dividing resistance values are the same in both the comparator in setting E5=E2, as the counter 55 is reset by the H level signal output when the Vin is equal to or granter than the Vin in the comparator 54, the CK2 is not counted). Moreover, the reason for use of the hysteresis comparator as a comparator for deciding the level of E5 is to prevent the signals CK1 and CK2 from being frequently switched therebetween near the threshold, so that the hysteresis width is made extremely small.

Thus, the substantial modification of the circuit can be avoided by switching between the frequencies of the clock signals in response to the result of level comparison when the lowering of Vin is detected. Though illustration is omitted, the form (1) or (2) is also applicable to the configuration shown in FIG. 15.

Although the arrangements described so far includes decreasing the supply of power to the discharge lamp in accordance with the effect of the lowering and lowering time of Vin and cutting off the supply of power to the discharge lamp by means of the signal SOF when it is forgotten to turn off the discharge lamp, informing the user of his forgetting to turn off the discharge lamp is also effective. In other words, warning using indicator display and a buzzer can be sent out by providing information as to decreasing or stopping the supply of power or otherwise utilizing the signal SOF as an abnormality detecting signal. When the condition in which the Vin falls to the threshold or lower lasts over the predetermined reference time, for example, the abnormality derived from the lowering of input voltage is decided to occur whereby to inform the user to the effect by issuing an abnormality notifying signal or in any other form of providing such information.

As is obvious from the description above, according to the invention, satisfactory measures can be taken to suppress the generation of heat in the discharge-lamp lighting circuit due to the ambient temperature rise as the supply of power to the discharge lamp is decreased as the ambient temperature rises when the DC input voltage lowers. Moreover, the inconvenience caused by excessively decreasing the supply of power to the discharge lamp when the ambient temperature lowers. Therefore, it is possible to take all possible measures by preventing the inconvenience caused by allowing the brightness of the discharge lamp to become weaker than what is prescribed when the ambient temperature lowers or the inconvenience caused by allowing the current limiting function for sufficiently preventing heat build-up and the power lowering function to be not demonstrated.

Further, the supply of power to the discharge lamp is controlled according to the signal detected and obtained via the ambient-temperature monitoring or compensating element connected to the detection element of the DC input voltage, whereby the influence of the ambient temperature can be eliminated without complication of the circuit configuration.

In this aspect, satisfactory safety measures can be taken to counter the harmful effect caused by the generation of heat in the circuit by taking into consideration the preset threshold with respect to the DC input voltage and the ambient temperature and the variation of the threshold.

Still further, when the DC-AC converter circuit falls to the threshold or lower (the lowering of the DC input voltage results in heat generation in the circuit, thus causing temperature rise), the consumption of the DC power supply is suppressed by controlling the supply of power to the discharge lamp in accordance with the lowering degree and lowering time. Moreover, measures to satisfactorily counter the heat generation can be taken when it is forgotten to turn off the discharge lamp, so that reducing the size of the apparatus (space saving) can also be dealt with.

In other aspect of this invention, the supply of power to the discharge lamp is cut off whereby to prevent the DC power supply from being consumed any longer in case where the lowering of the DC input voltage is conspicuous.

Further, the condition in which the supply of power to the discharge lamp is cut off is maintained until the power is fed thereto again, whereby to prevent the DC input voltage from being consumed and to suppress the temperature rise in the circuit.

Still further, the resetting of the discharge lamp is made possible as the discharge lamp is allowed to be turned on again without depending on the refeeding of power at the time the DC input voltage temporarily lowers. In the application of the invention to a vehicle discharge lamp, for example, the safety of a vehicle during its travelling at night can be enhanced.

In another feature, the time required to turn on the discharge lamp again can be shortened by decreasing the time required to reset the discharge lamp as the recovery of the DC input voltage quickens.

In yet another, the discharge lamp is turned off at early timing by shortening the time required to cut off the supply of power as the lowering of the DC input voltage increases.

What is claimed is:

1. A discharge-lamp lighting circuit comprising: a DC-DC converter circuit for boosting or lowering a DC input voltage from a DC power supply, a DC-AC converter circuit for converting an output voltage of the DC-DC converter circuit to an AC voltage, and a control circuit for controlling a supply of electric power to a discharge lamp, whereby the supply of power to the discharge lamp is controlled by the control circuit in response to a lowering of the DC input voltage when the lowering of the DC input voltage is detected, wherein power control is performed so that the supply of power to the discharge lamp is decreased by the control circuit as the ambient temperature rises even though the lowering of the DC input voltage remains unchanged.

2. The discharge-lamp lighting circuit as claimed in claim 1, wherein detection elements for detecting the DC input voltage are provided and wherein the supply of power to the discharge lamp is controlled by the control circuit according to a signal detected and obtained via an ambient-temperature monitoring or compensating element connected to each detection element.

3. The discharge-lamp lighting circuit as claimed in claim 1, wherein when the DC input voltage falls to a threshold or lower, power control is performed so that the supply of power to the discharge lamp is decreased by the control circuit as the lowering degree grows greater and as a time during which the DC input voltage remains at the threshold or lower grows longer.

4. The discharge-lamp lighting circuit as claimed in claim 1, wherein when the DC input voltage comes to have a preset threshold or lower or when the ambient temperature comes to have a preset threshold temperature or higher, the supply of power to the discharge lamp is decreased by the control circuit.

5. The discharge-lamp lighting circuit as claimed in claim 4, wherein the threshold concerned with the DC input voltage increases as the ambient temperature rises or the threshold concerned with the ambient temperature decreases as the DC input voltage lowers.

6. A discharge-lamp lighting circuit comprising: a DC-DC converter circuit for boosting or lowering a DC input voltage from a DC power supply, a DC-AC converter circuit for converting an output voltage of the DC-DC converter circuit to an AC voltage, and a control circuit for controlling a supply of electric power to a discharge lamp, whereby the supply of power to the discharge lamp is controlled by the control circuit in response to a lowering of the DC input voltage when the fall of the DC input voltage to a threshold or lower is detected, wherein power control is performed so that when the DC input voltage falls to the threshold or lower, the supply of power to the discharge lamp is decreased by the control circuit as the lowering degree grows greater and as a time during which the DC input voltage remains at the threshold or lower grows longer.

7. The discharge-lamp lighting circuit as claimed in either claim 6, wherein when the time during which the DC input voltage remains at the threshold or lower lasts for a predetermined reference time, the supply of power to the discharge lamp is cut off.

8. The discharge-lamp lighting circuit as claimed in claim 7, wherein a condition in which the supply of power to the discharge lamp is cut off is maintained until the power is fed thereto again.

9. The discharge-lamp lighting circuit as claimed in claim 7, wherein a reference voltage higher than the reference voltage at the time the lowering of the DC input voltage is detected is set and wherein when the DC input voltage recovers to the reference voltage or higher after the supply of power to the discharge lamp is cut off, the discharge lamp is allowed to be turned on again.

10. The discharge-lamp lighting circuit as claimed in claim 7, wherein the length of the reference time is shortened as the lowering degree of the DC input voltage grows greater.

11. The discharge-lamp lighting circuit as claimed in claim 7, wherein a reference voltage equal to or higher than the reference voltage at the time the lowering of the DC input voltage is detected is set and wherein when the DC input voltage recovers to the reference voltage or higher after the supply of power to the discharge lamp is cut off and when this condition lasts over the predetermined reference time, the discharge lamp is allowed to be turned on again.

12. The discharge-lamp lighting circuit as claimed in claim 11, wherein after the supply of power to the discharge lamp is cut off, a length of the reference time is shortened as recovery of the DC input voltage grows faster.

* * * * *